United States Patent [19]

Gibbs

[11] Patent Number: 4,482,153

[45] Date of Patent: Nov. 13, 1984

[54] KNOCK-OUT GAME

[76] Inventor: Don W. Gibbs, 4739 Hackamore Dr. N., Colorado Springs, Colo. 80918

[21] Appl. No.: 467,983

[22] Filed: Feb. 18, 1983

[51] Int. Cl.[3] ..... A63F 7/06

[52] U.S. Cl. ..... 273/85 R; 273/118 R; 273/126 R; D21/11

[58] Field of Search ..... 273/85, 118, 122, 126; D21/7, 11

[56] References Cited

U.S. PATENT DOCUMENTS

| | | | |
|---|---|---|---|
| D. 86,218 | 2/1932 | Cannon | D21/7 X |
| 1,624,469 | 4/1927 | Brown | 273/85 R |
| 1,634,016 | 6/1927 | Brown | 273/85 R |
| 2,492,447 | 12/1949 | Schwartz | 273/85 R |
| 3,391,933 | 9/1968 | Cooper | 273/85 |
| 3,741,541 | 6/1973 | Grisman | 273/85 H |
| 3,912,369 | 10/1975 | Barlow | 273/85 B |
| 3,913,918 | 10/1975 | Trachtman | 273/126 R |
| 4,007,932 | 2/1977 | Lebrun | 273/85 F |
| 4,261,568 | 4/1981 | Such | 273/85 R |
| 4,412,680 | 11/1983 | Zorn | 273/126 R X |

FOREIGN PATENT DOCUMENTS

| | | | |
|---|---|---|---|
| 754944 | 3/1967 | Canada | 273/126 R |
| 6608129 | 12/1967 | Netherlands | 273/85 B |
| 216606 | 6/1924 | United Kingdom | 273/85 R |
| 446706 | 5/1936 | United Kingdom | 273/85 R |

*Primary Examiner*—Paul E. Shapiro

*Attorney, Agent, or Firm*—Henderson & Sturm

[57] ABSTRACT

This invention relates in general to a rolling sphere or sliding disk game, played on a generally hexagonal playing surface; wherein, a plurality of elongated mallets are disposed on the opposite ends of the game board, and the goals are positioned at the normal juncture of the angled sides. In addition, the playing surface is further provided with obstructions that limit the horizontal arc that the individual mallets can traverse on the playing surface.

10 Claims, 2 Drawing Figures

FIG. 1
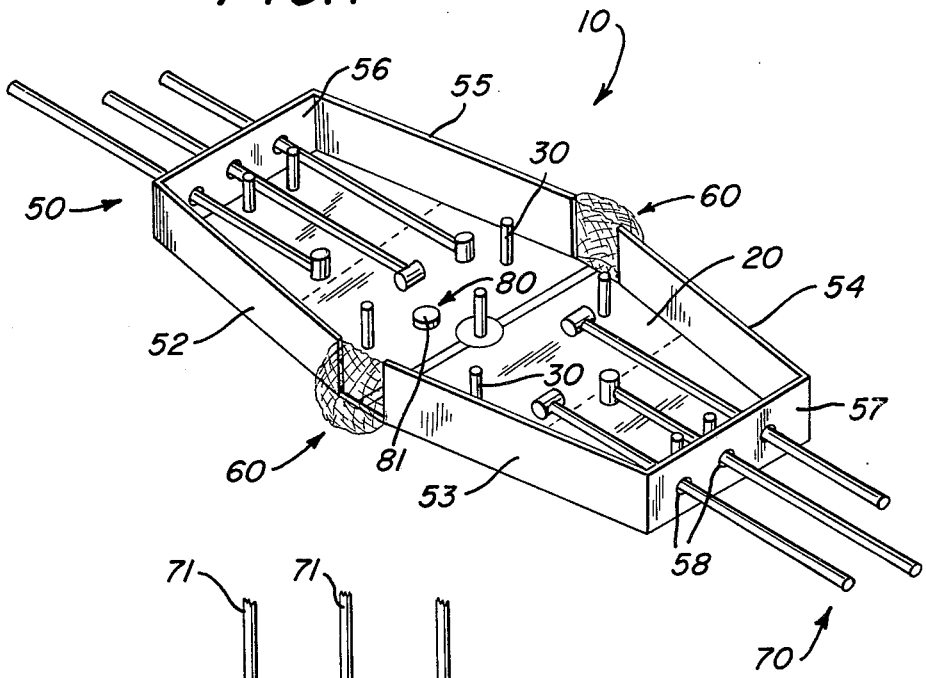
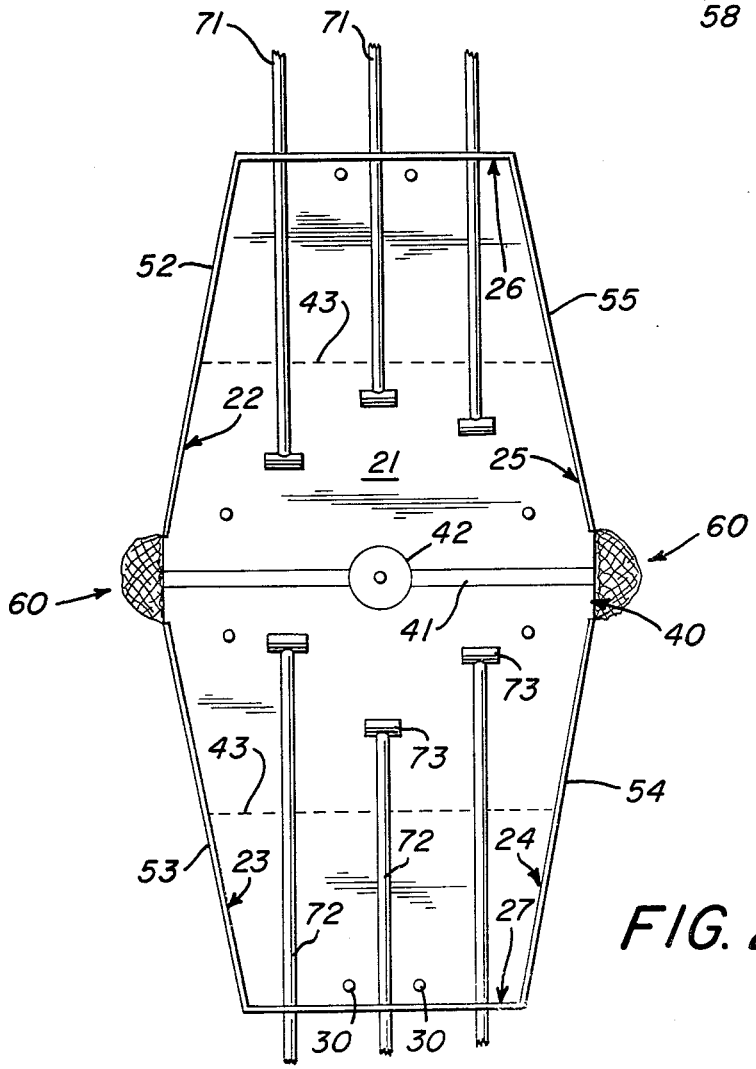
FIG. 2

KNOCK-OUT GAME

BACKGROUND OF THE INVENTION

The prior art is replete with simulated hockey and soccer style game boards and playing apparatus, as can be seen by reference to the following U.S. Pat. Nos.: 4,007,932; 4,261,568; 3,912,269 and 3,391,933.

While the above cited patents comprise only a very small representative sample of games of this type; it would be safe to say that almost all of the hockey/soccer style games can be characterized by the following features; elongated rectangular or generally rectangular playing surfaces; goals mounted on either end of the elongated playing surface; and mechanical or manually actuated striking means for propelling a disk or sphere primarily along the long dimension of the elongated playing surface.

While games of this type may have enjoyed a modicum of popularity in the past, the profusion of this type of apparatus in its various forms has resulted in a waning enthusiasim by the consumer. This can be attributed in large part to the following factors; each of the games employs the same principles and strategy; once one of the games has been mastered, the desire to become proficient in a mere variation is substantially reduced; and the difference between most of the versions, is so subtle that it becomes barely noticable, particularly among young children for whom most of these games have been developed.

Based on the foregoing facts, it became evident that an entirely new game was needed, that would require strategy and tactics quite distinct from the tactics employed in the prior art games; and the this would require an entirely new approach to not only the construction of the game board and positioning of the goals, but also the propelling means used in conjunction therewith. As a result, the game board and associated apparatus that forms the basis of the present invention was developed.

SUMMARY OF THE INVENTION

An object of the present invention is to provide a new and unique game board and apparatus for use in conjunction therewith.

Another object of the present invention is to provide a game that requires totally different tactics and strategy from prior art games.

Yet another object of the present invention is to provide a game board having a unique cooperation between the angled walls disposed on either side of the goal mouths.

Still another object of the present invention is to provide a playing surface; wherein, the side walls on each side are angled to deflect a rolling sphere or sliding pack in the general direction of the goal mouth on the opposite side.

A further object of the present invention is to provide a game board wherein the puck or sphere propelling means are in the form of mallets, whose path of travel in a horizontal arc is limited by obstructions, in the form of the side walls and pegs disposed on the playing surface.

A yet further object of the present invention is to provide a game that is innovative of the various elements, and will therefore receive widespread commercial success, while providing a medium that will entertain and give enjoyment to various age groups, regardless of their levels of skill.

These and other objects, advantages, and novel features of the invention will become readily apparent from the detailed description that follows, when reviewed in conjunction with the accompanying drawings.

BRIEF DESCRIPTION OF THE DRAWINGS

FIG. 1, is a perspective view of the game board and playing pieces.

FIG. 2, is a top plan view of the game board and playing pieces.

DETAILED DESCRIPTION OF THE PREFERRED EMBODIMENT

As can best be seen by reference to FIG. 1, the game that forms the basis of the present invention is designated generally as 10, and comprises a playing surface 20, surrounded by a vertical wall member 50 having goals 60 disposed therein, and a plurality of propelling means 70, for use in propelling game piece 80 across the playing surface.

The playing surface 20, comprises a flat, elongated, generally hexagonal member 21, whose sides 22,23,24 and 25 are substantially longer than the ends 26 and 27. In addition, the playing surface 20 has a plurality of apertures formed therein, which are dimensioned to receive a plurality of pegs 20, whose purpose and function will be explained in detail further on in the specification. The playing surface 20 is also provided with markings 40, which divide the playing surface into different playing zones.

The vertical wall member 50 comprises side wa11s 52,53, 54 and 55, and end walls 56 and 57. The vertical wall member 50, extends completely around the periphery of the playing surface 20, with the exception of the area occupied by the goals 60, which are disposed at what would normally be the juncture of side walls 52,53 and 54,55. The goals are therefore disposed on either side of the mid-point of the elongated hexagonal playing surface 20, as opposed to the ends 26 and 27.

As can best be seen by reference to FIG. 2, the goals are formed by openings in the wall member 50, and the playing surface 20 is squared off adjacent the goals, so that the goal openings are parallel and diametrically opposed to one another.

Turning now to FIG. 1, it can be seen that the end walls 56 and 57, are provided with a plurality of enlarged apertures 58, that are dimensioned to loosely receive a portion of the propelling means 60.

The propelling means 70, comprise mallets 71, having an elongated handles 72 and an enlarged cylindrical heads 73. The reasons that the apertures 58 are oversized, is to allow the mallets to ravel in an arc to strike the game piece 80 and propel it through one of the goals 60. As will be seen later on in the specification, the only mode permissable to advance the game piece 80, is by "striking".

The game piece 80, is illustrated in the drawings is in the form of a puck or flat disk 81, which slides across the playing surface 20 in response to the force imparted by one of the plurality of mallets 71. It should be noted at this point that even though the game piece 80 in the preferred embodiment comprises a disk, this invention also encompasses the substitution of a spherical object (not shown) for the cylindrical disk.

As mentioned, supra, the playing surface 20, is provided with a plurality of pegs 20 and markings 40. The markings 40, divide the playing surface 20 into different playing zones. The markings 40 comprise a center stripe 41, having an enlarged face-off circle 42, disposed at its mid-point, and one or more zone stripes 43, dividing each half of the playing surface into different playing zones. The pegs serve a dual function, in that they limit the arc that an individual mallet 71 may traverse; and they also provide obstacles for the path of travel of the object 80.

As shown in the drawings one group of pegs 30 is disposed proximate to, and spaced between, the apertures 58 in the end walls, while another group of pegs is disposed proximate to, but spaced from, the goal openings 60, and a single peg is centrally disposed in the face-off circle 42.

The rules of the game, and the cooperation between the various structural elements to accomplish the same will now be described in detail. In the preferred embodiment each end of the game is provided with three mallets that can be selectively moved to propel the disk 81, or positioned to obstruct its travel.

The object of the game is to have each player attempt to propel the disk 81, through the goal opening 60, on their right hand side. The game begins by having the disk 81, balanced upon the top of the peg 30, in the face-off circle 42; whereupon, both players manipulate their mallets to knock the disk 81 off the peg 30, and in the direction of, and ultimately through their respective goal.

As mentioned, supra, according to the rules the disks can only be advanced by striking the game piece with any of the mallets in an arc, and cannot be advanced by sliding the disk across the playing surface, as in shuffleboard.

The pegs 30 alone, or in combination with the side walls, limit the arc through which any of the mallets can travel. In the embodiment shown in FIGS. 1 and 2, the pegs 30 proximate the end walls determine the arc that the middle mallet can traverse, regardless of the length of the mallet handle that extends over the playing surface. With respect to the mallets on either side of the middle mallet; the side walls and the pegs proximate the goal openings, limit the long handle strokes.

Referring now particularly to the left side of FIG. 1, it can be seen that the mallet heads 73, can be disposed vertically or horizontally. In the vertical disposition, they are employed as additional stationary obstacles to the path of travel of the game piece. In the horizontal disposition, they are employed as striking members to advance the game piece 80.

The angled walls 52 thru 55, and pegs also act as bumpers for the game piece 80, which can be fabricated from wood, rubber, plastic or other suitable material. In addition, due to the fact that the side walls are angled in the manner shown, the game piece will rebound against one side wall, in the direction of the goal opening in the opposite side wall.

It should also be noted that the enlarged mallet heads 73, are dimensioned, so that their wall be sufficient clearance between the elongated handles 72 and the playing surface 20 to allow passage of a disk 81, even when the mallet heads 73 are in their horizontal disposition.

After the disk has been knocked out of the face-off circle, the players use selective mallets to propel and block the travel of the disk, until one of the players is successful in propelling the disk through one of the goal openings.

Realizing that various rules may be devised to govern the sequence of play, not only over the playing surface 20, as a whole, but also with respect to play within the various playing zones delineated by the markings 40; specific rules are not considered to be part of this invention, only the general structure and cooperation between the elements disclosed herein.

Having thereby described the subject matter of this invention, it should be obvious that many substitutions, modifications and variations of the invention are possible in light of the above teachings. It is therefore to be understood that the invention as taught and described is only to be limited to the extent of the breadth and scope of the appended claims.

What I claim is:

1. A game board and playing pieces comprising:
an elongated generally hexagonal playing surface,
a wall member surrounding said playing surface, and having apertured end walls, and side walls that create goal openings on both sides of the playing surface,
propelling means extending through the apertures in each of the end walls, and
a game piece adapted to be contacted by said propelling means, to direct the game piece through said goal openings.

2. A game board and playing pieces as in claim 1; wherein, the playing surface further comprises:
a plurality of pegs disposed on said playing surface,
markings formed on the playing surface to delineate playing zones.

3. A game board and playing pieces as in claim 2; wherein,
the propelling means comprise a plurality of mallets having elongated handles and enlarged heads.

4. A game board and playing pieces as in claim 3; wherein,
the game piece comprises a flat disk that is dimensioned to pass under the elongated handle of the mallet.

5. A game board and playing pieces as in claim 4; wherein,
the enlarged apertures are dimensioned to permit the elongated handles to be swung in an arc across the playing surface.

6. A game board and playing pieces as in claim 5; wherein,
selected groups of the plurality of pegs cooperate to limited the arc of travel of at least one of the plurality of mallets, on each end of the playing surface.

7. A game board and playing pieces as in claim 5; wherein,
the side walls and other selected groups of the plurality of pegs cooperate to limit the arc of travel of at least two other of the plurality of mallets on each end of the playing surface.

8. A game board and playing pieces as in claim 7; wherein,
the side walls, the pegs and at least some of the mallets form bumpers that will alter the path of travel of the game piece across the playing surface.

9. A game board and playing pieces as in claim 8; wherein,
the side walls on each side of the playing surface are disposed with respect to the goal openings on the opposing side, so that the contact of the playing piece against the side wall on one side, will propel the playing piece in the direction of the goal opening on the other side.

10. A game board and playing pieces as in claim 3; wherein,
the game piece comprises a spherical object.

* * * * *